United States Patent [19]

Kurling

[11] 4,369,952

[45] Jan. 25, 1983

[54] MANUALLY DRIVEN WINCH

[76] Inventor: Lennart Kurling, Berglärkan 81, 421 69 Västra Frölunda, Sweden

[21] Appl. No.: 233,205

[22] Filed: Feb. 10, 1981

[30] Foreign Application Priority Data

Feb. 11, 1980 [SE] Sweden ..... 8001056

[51] Int. Cl.[3] ..... B66D 1/22; B66D 1/30; B66D 1/78

[52] U.S. Cl. ..... 254/353; 254/344; 254/371; 74/812

[58] Field of Search ..... 254/371, 342, 352, 353, 254/354; 74/88, 812

[56] References Cited

U.S. PATENT DOCUMENTS

| | | | |
|---|---|---|---|
| 1,710,774 | 4/1929 | Kinser | 254/352 |
| 3,942,762 | 3/1976 | Reymond | 254/352 |
| 3,968,953 | 7/1976 | Guangorena | 254/352 |
| 4,254,940 | 3/1981 | Thyvold | 254/341 |
| 4,303,225 | 12/1981 | Engwall | 254/371 |

*Primary Examiner*—Billy S. Taylor
*Attorney, Agent, or Firm*—Young & Thompson

[57] ABSTRACT

The present invention relates to a manually driven winch, preferably intended as a sheet winch on sailboats, with which sheeting can be performed with the required mechanical advantage between the ingoing and the outgoing parts of the sheet, by imparting to the outgoing portion of the sheet a reciprocal pumping movement, which is used to drive the winch drum.

10 Claims, 7 Drawing Figures

MANUALLY DRIVEN WINCH

The present invention relates to a manually driven winch, preferably intended for use as a sheet winch on sailboats.

In recent years sheet winches have developed into two dominant types, on the one hand those with a single winding drum, and those provided above the winding drum with a slot rotating with the drum in which slot the line can be jammed so that it is always held under tension around the winding drum. This latter type is usually called "selftailing".

Both of these types of winches are usually provided with a spindle in the upper end of which there is a socket into which a winch handle or crank can be inserted for driving the winch. The crank can be quickly removed to be moved between the two sides of the boat for tacking. A winch of the latter type is revealed in U.S. Pat. No. 3,968,953.

Winches provided with winch handles of this type have several advantages. They are easily placed and they can be made with several gear speeds between the winch handle and drum, the shifting of the gearing being accomplished by reversing the rotational direction of the winch handle.

However, these known winches also have several disadvantages. Because the winch handle has a length of about 20 cm, it is usually removed from the winch when the sheet is wrapped around the winch drum. The winch handle must also be removed when the sheet is removed from the winch when coming about. It is therefore common to use the same winch handle for both sheet winches, moving it from the lee winch to the windward winch after the windward winch has been prepared for use after coming about by winding the sheet the required number of times around the drum.

When sailing to windward and in tight situations this procedure often results in losing the winch handle overboard or fouling the sheet in the winch handle.

Due to the fact that the sheet is wound around the drum the required number of turns before the winch handle is inserted, and thus even before the initial step of pulling in the sheet by hand, using the winch only as a ratchet, it is not uncommon that the turns around the drum will overlap so that one portion is locked by the ingoing portion, rendering the winch unusable. In heavy weather, when there is great tension in the sheet, dangerous situations can occur since such "running hitches" usually take some time to undo.

The purpose of the present invention is to achieve a winch which has the same advantages as those mentioned above, but in which the required mechanical advantage can be achieved without a winch handle. Instead, the outgoing line from the winch is used as a power means. By imparting a reciprocal pumping movement to the line the winch operator can drive the winch drum intermittently.

A number of advantages are achieved with this construction:

There are no projecting parts which sheets and other lines can be fouled on.

The placement of the winch is freer, since there is no winch handle which must swing clear of all stays and manropes.

When coming about, both winches can be used at the same time, which is important if the boat does not come through the eye of the wind and falls back so that the lee winch must again be used even after sheeting has already been prepared for the windward winch.

During the first stage of sheeting, one or two turns can be taken around the drum and later be supplemented with the required number, thus eliminating the risk of the line becoming jammed.

In racing and sailing in narrow waters with frequent changes of heading, the helmsman can sit on the windward cockpit coaming and at the same time steer and handle the sheet since it is possible to ease and pull in the sheet with the outgoing line in one hand regardless of the distance to the winch.

Further advantages would be evident from the following description of preferred embodiments, which refers to the accompanying drawings, of which:

Figure 1:
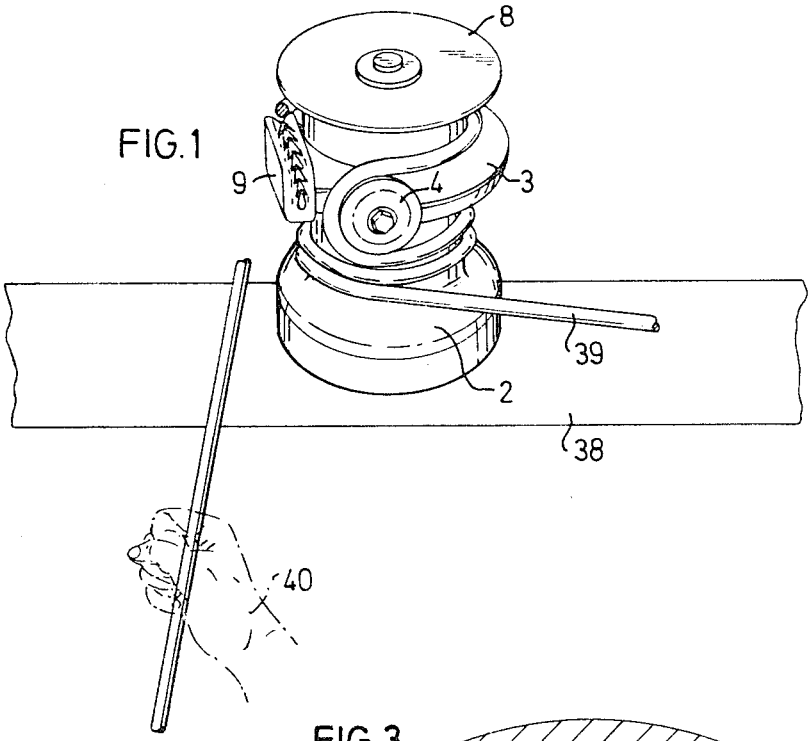
FIG. 1 shows a view of the winch during the sheeting operation.

The winch according to FIGS. 1–6 consists of a frame 1 on which a winch drum 2 is mounted with needle bearings 10. A disc-shaped support means 3 is also mounted on the frame by means of a spindle 11, with which the support means 3 is non-rotatably joined. Above the support means there is an additional drum 8 freely rotatably journalled on the spindle 11.

A pulley 4 is freely rotatably mounted on the periphery of the support means. The pulley is recessed into a cavity in the outer portion 12 of the support means, said portion serving as a flange for the drums 2 and 8 and which separates them from each other. The drum 8 is also made with a flange, and the lower portion of the winch drum 2 forms both a flange and a gear housing.

Figure 3:
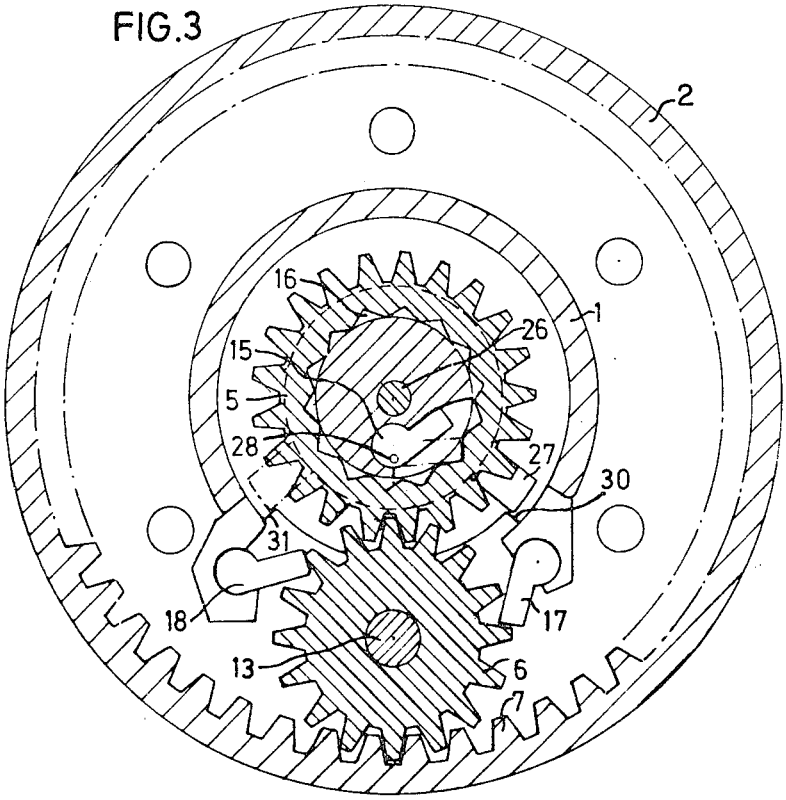
FIG. 3 is a horizontal section along the line III—III in FIG. 2.
Figure 2:
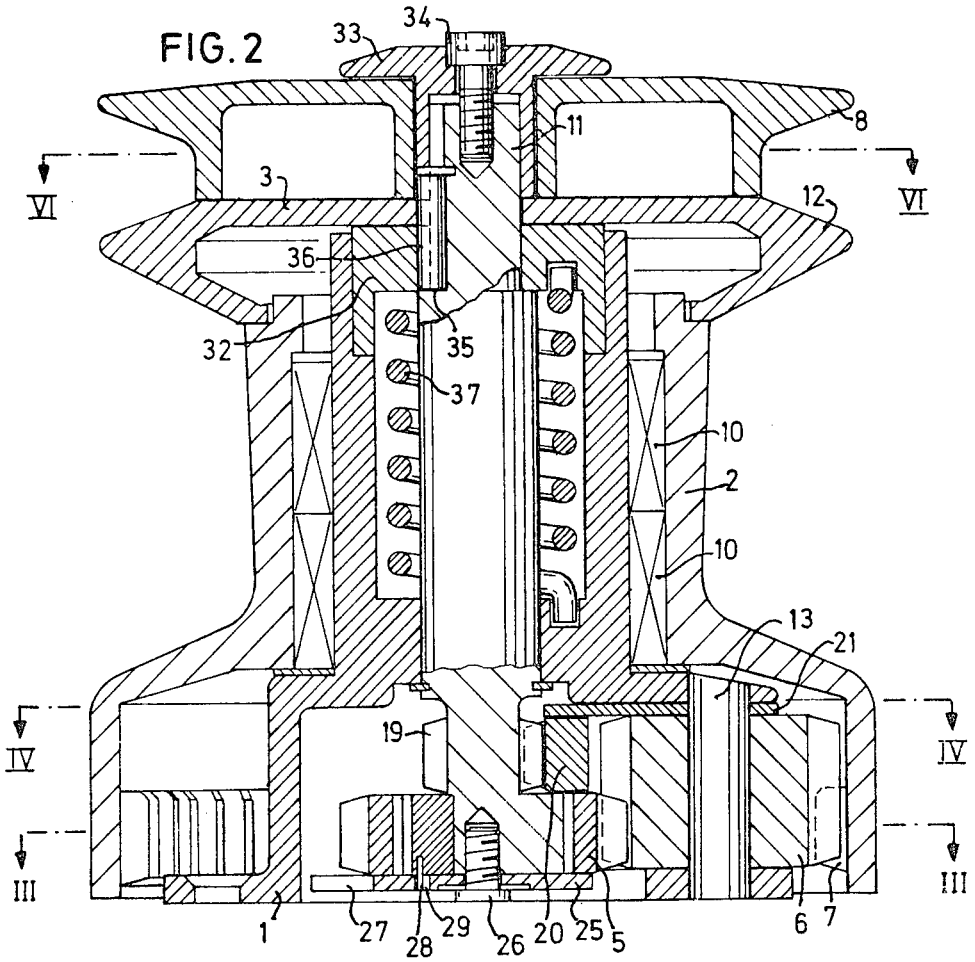
FIG. 2 is a vertical section through a 2-speed embodiment of the winch.

The lower portion of the winch drum as shown in FIG. 3 is provided on its inside with a gear ring 7 which engages an intermediate gear 6 mounted on a shaft 13 in the frame. A gear 5 is mounted at the lower end of the spindle 11 and engages the intermediate gear 6. A ratchet catch 15 arranged on the spindle engages a toothed ring 16 on the inside of the gear 5 and drives said gear when the spindle is rotated counter-clockwise. Two additional ratchet catches 17 and 18 are arranged in the frame and they engage the teeth on the gear 6 blocking the gear and thereby the winch drum against counter-clockwise rotation.

All of the ratchet catches in the winch are of known types and are biassed toward the catch position by a spring (not shown).

Figure 4:
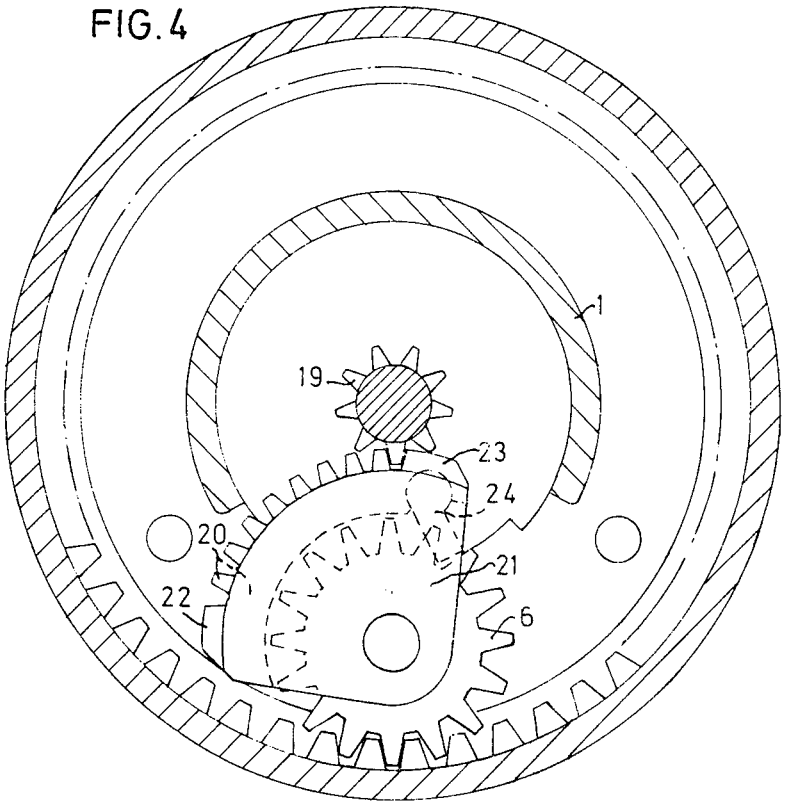
FIG. 4 is a horizontal section along the line IV—IV in FIG. 2.
Figure 5:
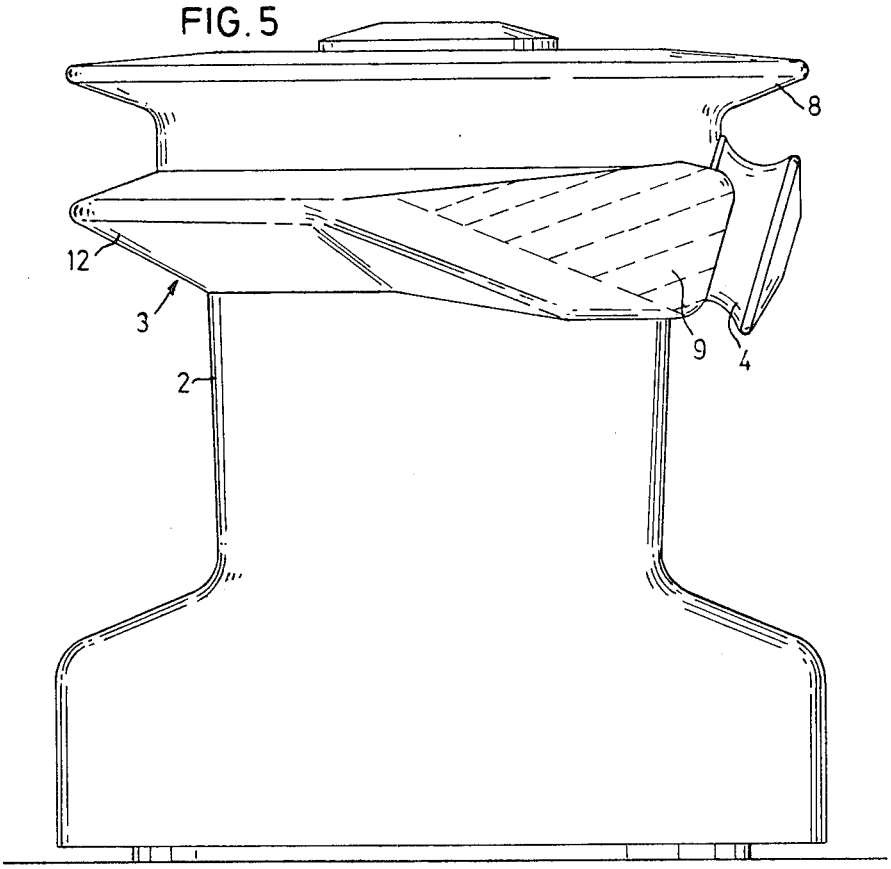
FIG. 5 is a side-view of the same embodiment.
Figure 6:
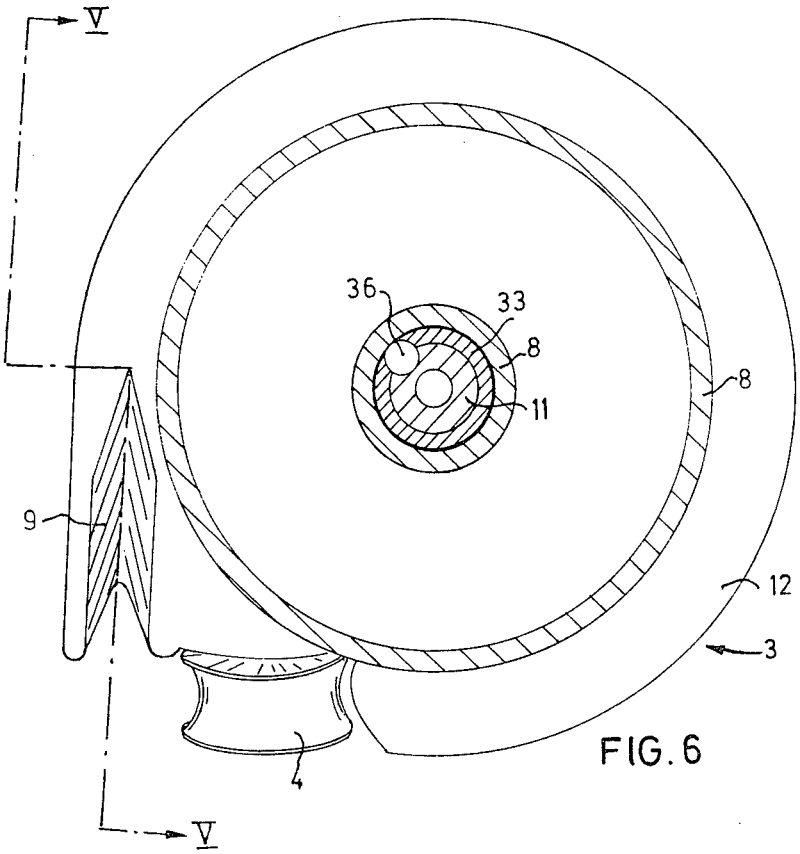
FIG. 6 is a horizontal section along the line VI—VI in FIG. 5.

As can be seen in FIG. 4, in the plane immediately above gear 5, the spindle is provided with a gear ring 19 of smaller diameter than the gear 5 and which engages a toothed rim 20 arranged on a plate-shaped carrier 21 mounted on the shaft 13 and guided between the frame and the gear 6. The gear 5 was omitted from this Figure for the sake of clarity.

The toothed rim 20 and the plate 21 form a circle sector of about 90°. The toothed rim 20 has stop heels 22 and 23 at its ends for abutting against the teeth of the gear ring 19 and thus limiting the rotation of the toothed rim 20 and the spindle.

The rotation of the spindle, and thereby that of the support means 3 and the pulley 4, is limited in this manner to about 270°.

The toothed rim 20 is provided at one end with a ratchet catch 24 which engages the upper plane of the gear 6 and is turned clockwise as a result of the spindle being turned counter-clockwise.

A disc 25 is attached to the bottom of the spindle by a screw 26. The disc is rotatable in relation to this spindle with frictional resistance and is provided with a tongue 27.

The ratchet catch 15 is provided with a pin 28 which extends into a cavity 29 in the disc 25. The bottom plate of the frame is made with two stop projections 30 and 31 being separated by an angle somewhat greater than 90°. The projections are designed to be an abutment for the tongue 27 when the spindle is turned to its end positions. This results in a rotation of a few degrees of the disc in relation to the spindle when the spindle is turned the whole way from one end position to the other.

This turning of the disc 25 in relation to the spindle brings the ratchet catch 15 out of the catch position. The friction between the disc and the spindle should be great enough to hold the catch in this position overcoming the force of the spring.

At the upper end of the spindle, in addition to the support means, it is also non-rotatably joined to a bearing body 32 and a holder 33. The holder 33 is axially joined to the spindle by means of a screw 34 and is arranged to press the support means 3 and the bearing body 32 axially against an abutment 35 on the spindle. A torsionally rigid connection between the spindle and the bearing body, the support means and the holder is achieved by means of a locking pin 36 arranged in grooves in the respective parts.

A torsion spring 37 is mounted between the bearing body 32 and the frame. It is intended to urge the support means clockwise towards one of its end positions, namely the one shown in FIGS. 1, 3 and 4.

The supporting means flange portion 12 next to the pulley 4 is made as a jam cleat 9 of a type which is known per se which consists of a slot with wedge-shaped grooves.

The embodiment described above functions during a sheeting operation in the following manner:

The winch is in the starting position shown in FIG. 1, where 38 designates the port side cockpit coaming, 39 designates the sheet and 40 the hand of the person handling the sheet. The pulley essentially faces directly into the cockpit and, in the end position shown in FIGS. 3 and 4, is under the influence of the torsion spring.

After the sheet has been wound the required number of turns clockwise around the winch drum, the person handling the sheet takes in as much as he is able by pulling the outgoing line of the sheet. When the pulling force in the sheet has increased so that he is no longer able to overcome it, he wraps the outgoing line over the pulley and then three quarters of a turn counter-clockwise around the upper free running drum. The friction of the sheet against the winch drum and the ratchet catches 17 and 18 prevent the sheet from running out from the winch provided one maintains a slight tension in the outgoing line.

By pulling the outgoing line it is now possible using less force to pull the pulley counter-clockwise around the axis of the winch and thus turn the winch drum clockwise via the reversing and reduction gearing comprised by the gears.

If the person handling the sheet rotates the pulley, and thus the support means, in this manner the entire or a portion of the possible turning angle of 270° to the other end position, he has performed something which we will call a pump stroke in the following. In a complete pump stroke he pulls in the sheet a length which correspond to 270/360 of the circumference of the upper drum plus 270/360 of the circumference of the winch drum plus the length pulled in through the rotation of the winch drum. When he then eases up on the sheet and allows the return spring to turn the support means with the pulley back, he allows the same length to be wound out again under the drums except for the portion which was pulled in by the turning of the winch drum, since the drum is stationary during the return movement.

By repeated reciprocal pumping strokes it is in principle possible to intermittently pull in an unlimited length of sheet. This is done as follows: During the first pumping stroke the upper gearing is engaged since the disc 25 has moved the ratchet catch out of the engaged position by the tongue 27 abutting against the projection 30. In this position the torque is transmitted from the pulley and the support means via the spindle and the upper gear ring 19 to the toothed rim 20 and on via the ratchet catch 24 to the intermediate gear 6 and via the inner gear ring 7 to the winch drum. By virtue of the fact that the diameter of the gear ring 19 is substantially less than that of the toothed rim 20, the reduction is high and therefore there is a high mechanical advantage but at the same time a low rotational speed of the winch drum with this gear speed. In order to obtain a smaller reduction, and thus a higher rotational speed of the winch drum, during the initial pumping strokes, the person pulling in the sheet engages the lower gearing by pulling the spindle to its other end position whereby the rotation of the tongue 27 is stopped by the projection 31 just before the rotation of the spindle is stopped by the heel 22 on the toothed rim 20. This produces a relative rotation of the disc 25 in relation to the spindle thus moving the catch 15 into the blocking position with the aid of its spring.

During the return portion of the first pumping stroke the winch drum is stationary due to the ratchet catches 17 and 18 while the spindle, the support means and the pulley are moved by the spring 37 to the first end position. The torque which the spring can apply to the support means must be great enough to produce the return movement without the person holding the sheet having to ease it so much that the sheet begins to slide on the winch drum.

Before the first end position has been reached, the person handling the sheet begins the second pumping stroke with the lower gearing remaining engaged. Since the diameter of the gear 5 is greater than that of gear 6, a relatively low gear ratio, and thus a smaller mechanical advantage, is obtained but at the same time the winch drum is turned more rapidly. When this gear is engaged the torque is transmitted from the spindle via the catch 15, the gears 5 and 6, and the inner gear ring 7 to the winch drum. Since the toothed rim 20 is turned more slowly than the gears 6, the catch 24 will "coast" in the same manner as it and catch 15 do during the return movement of the spindle.

With the lower gearing engaged, the person handling the sheet carries out pumping strokes, without striking the first end position, until the pulling force in the sheet is so great that he is no longer able to turn the support means.

In order to engage the upper gearing again, which has a higher gear ratio and thus provides an increased mechanical advantage, the support means is allowed to go all the way back to its first end position, the starting position. The tongue 27 strikes against the stop projection 30 and the ratchet catch 15 is moved out of engagement.

As long as one avoids allowing the support means to go all the way to its second end position, the upper gearing will be engaged.

When the sheet has been pulled in sufficiently, the support means is allowed to return to the starting position by easing the outgoing line, which is then wedged tightly in the jam cleat 9.

It is apparent that with the embodiment of the winch described above, foresail sheets in recreational boats of varying sizes can be handled simply and easily. By selecting suitable diameter ratios of the gears in the gear arrangements, it is possible to obtain the same mechanical advantages as those in known types of sheet winches of comparable size.

The mechanical advantage can also be varied within certain limits by varying the ratio between the diameters of the drum 8 and the winch drum. The angle in the vertical plane of the axis of rotation of the pulley must be adapted thereto. The maximum length of the pumping stroke can also be varied in this manner. Because the rotational axis of the pulley is located at a distance from the winch axis which exceeds the radius of the pulley, this relieves the oblique forces on the pulley and makes possible a low height of the upper portion of the winch.

By selecting the maximum turning angle of the support means to be 270° and by placing the jam cleat and the pulley next to each other, with the orientation of the jam cleat essentially parallel to the axis of the pulley one achieves both convenient handling when looping the sheet over the pulley and the upper drum as well as convenient blocking of the sheet.

The fact that the torsion spring 37 is mounted between the bearing body 32 and the frame and the fact that the support means and the drum 8 can be removed after the holder 33 has been taken off make it possible to remove the winch drum and thus screw the frame securely to its base without having to release the tension in the torsion spring.

Figure 7:
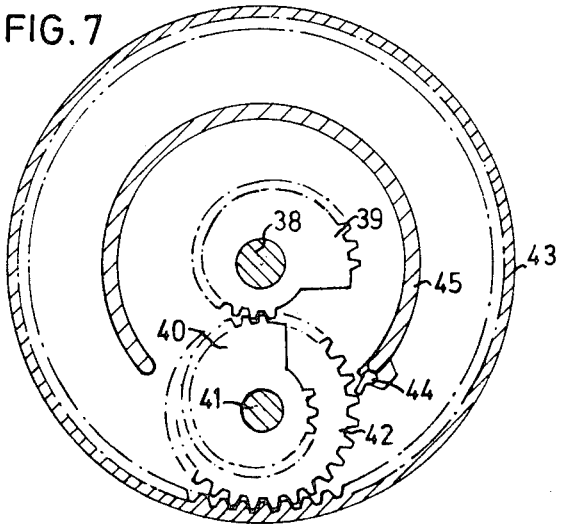
FIG. 7 is a horizontal section through a 1-speed embodiment of the winch.

FIG. 7 shows a horizontal section through the gear housing of a one-speed embodiment of the invention in which a spindle 38 is securely joined to a spiro-shaped gear 39 which engages an identical gear 40 mounted on an intermediate shaft 41. On the same shaft, in a plane beneath the gear 40, a cylindrical gear 42 is mounted which engages the winch drum 43. A ratchet catch 44 mounted on the frame 45 prevents the gear 42, and thus the winch drum, from turning counter-clockwise. A catch (not shown) is arranged between gears 40 and 42 in such a manner that the gear 40 drives the gear 42 when rotated clockwise.

The position shown is the starting position for a pumping stroke in which the mechanical advantage increases depending on the position of the spindle.

In this embodiment as well, the turning of the spindle is limited to 270°. If in the first stage of pulling in the sheet, a low gear ratio is desired, and thereby a rapid turning of the winch drum, the first pumping stroke is taken all the way out and then a relatively short reciprocal pumping movement is performed in the vicinity of the second end position of the spindle. As the pulling force of the sheet increases, one approaches the first end position of the spindle with the pumping movement until the spindle reaches the end in this position. A short pumping movement in this portion of the maximum pumping stroke provides a high mechanical advantage.

This latter embodiment is especially suitable for small winches with moderate gear reduction requirement since it is of simple construction and thus inexpensive to manufacture.

Additional embodiments are conceivable within the scope of the accompanying claims. The reversing gear can of course be made with one speed with cylindrical gears. Also the return spring can be replaced or be supplemented with a gearing arrangement between the spindle and the winch drum with a very high gear ratio, in which the torque on the winch drum is used to move the spindle to its starting position. A small portion of each pumping stroke is lost in this case, however, by the winch drum being turned back somewhat during the return of the spindle.

The driving connection between the spindle and the winch drum need not be a gear mechanism but can be various types of cam/roller means or lever mechanisms.

The invention is of course not limited to sheet winches but also comprises other types of winches, where the inventive principle imparts advantages.

According to a further proposed embodiment (not shown), instead of being arranged between the support means and the winch drum, the driving connection can be coupled between the additional drum and the winch drum. In this case the additional drum must be made so that sufficient friction can be achieved against the line portion which runs around the drum so that a pulling force in the outgoing line is transformed into a torque on the additional drum, sufficiently large to drive the winch drum.

What I claim is:

1. Manually driven winch, comprising a frame and a winch drum carried by the frame and rotatable in one direction, characterized by a support means arranged coaxial to the winch drum and provided with a pulley, means mounting said support means for rotation relative to the frame between first and second end positions which are angularly spaced apart, an additional drum arranged coaxial to the winch drum, a ratchet latch drivingly interconnecting the support means or the additional drum with the winch drum to drive the winch drum as the support means is rotated from the first to the second end position by a pulling movement of the outgoing portion of a line which is pulled around the winch drum over the pulley and around the additional drum in a direction opposite the direction of the line around the winch drum, and means to return the support means to the first end position after turning the support member from the first to the second end position.

2. Winch according to claim 1 and a reversing gear mechanism that drivably connects the support means to the winch drum, and means freely rotatably mounting the additional drum on the winch.

3. Winch according to claim 1, characterized in that the support means forms a flange axially delimiting the winch drum and the additional drum.

4. Winch according to claim 1, characterized in that the driving connection is a reduction gearing and comprises two selectively engageable gear speeds.

5. Winch according to claim 2, characterized in that the reversing gear is constructed so that the gear ratio varies depending on the angle of rotation of the support means.

6. Winch according to claim 2, characterized in that the support means is rotatable approximately 270°.

7. Winch according to claim 1, characterized in that the axis of the pulley is essentially perpendicular to the axis of the winch drum and that a first and a second tangent to the periphery of the pulley are tangent to the winch drum and the additional drum, respectively.

8. Winch according to claim 3, characterized in that a jam cleat is arranged in the flange portion of the support means, for locking a line portion pulled around the additional drum.

9. Winch according to claim 4, characterized in that means are arranged for engaging the respective gear speeds upon rotation of the support means to its respective end positions.

10. Winch according to claim 1, characterized in that the means for achieving the return movement of the support means is a spring means.

* * * * *